US005432979A

United States Patent [19]

Harper

[11] Patent Number: 5,432,979

[45] Date of Patent: Jul. 18, 1995

[54] DOOR HARDWARE PAINT SHIELD

[76] Inventor: Jack D. Harper, 2424 W. Dudley, Fresno, Calif. 93728

[21] Appl. No.: 144,154

[22] Filed: Oct. 26, 1993

[51] Int. Cl.[6] ..... E05D 11/00; B05C 11/16; B05B 15/04

[52] U.S. Cl. ..... 16/251; 16/DIG. 2; 118/505

[58] Field of Search ..... 16/250, 251, DIG. 2, 16/222; 118/504, 505

[56] References Cited

U.S. PATENT DOCUMENTS

| | | | |
|---|---|---|---|
| 3,422,486 | 1/1969 | Thomas | 16/251 |
| 3,961,602 | 6/1976 | Dresser . | |
| 4,195,590 | 4/1980 | Herrington . | |
| 4,570,291 | 2/1986 | Smith et al. | 16/250 |
| 4,691,409 | 9/1987 | Torgerson et al. | 16/250 |
| 4,796,330 | 1/1989 | Zeigler | 16/251 |
| 4,802,259 | 2/1989 | Geslewitz | 16/251 |
| 5,056,191 | 10/1991 | Love | 16/251 |
| 5,198,031 | 3/1993 | Derstine . | |
| 5,224,240 | 7/1993 | Smith et al. | 16/251 |
| 5,285,014 | 2/1994 | Gilchrist | 16/DIG. 2 |

*Primary Examiner*—Lowell A. Larson
*Assistant Examiner*—Donald M. Gurley
*Attorney, Agent, or Firm*—Mark D. Miller

[57] ABSTRACT

A disposable mask for door hinge and butt plate hardware designed to be slided onto the hardware instead of being frictionally clipped onto it. The mask includes a flattened plate attached to a cylindrical body and is distinguished by a longitudinal crease defining a weakened line along the cylindrical body and a tab either on said plate or on said cylinder. After use, a screwdriver or human finger may be used to apply pressure to the tab causing the mask to break along the weakened line so that it falls harmlessly from the door hardware in two disposable pieces.

15 Claims, 4 Drawing Sheets

DOOR HARDWARE PAINT SHIELD

BACKGROUND OF THE INVENTION

1. Field of the Invention

The present invention relates to paint shields, and in particular to a removable disposable paint shield for use on door hinge hardware.

2. Description of the Prior Art

Doors, door frames and door jams are often painted or treated with materials or colors that are different from those on adjacent walls or from each other. In new building construction, the framing and hanging of doors usually occurs far before the doors, jams, frames or walls are treated or painted. Doors must be properly hung in order to swing freely and close tightly, a process which is made possible in part through adjustments in the positioning of the door on its hardware hinges.

In any new building construction, there are often several similar doors for the various rooms of the building. In hotels, apartments, or office buildings the numbers of similar (or identical) doors may run into the hundreds or thousands. Painting or treating these large numbers of doors and the door jams in which they are mounted at one time is economical and efficient. Presently, in new construction, numerous doors are often taken down from their fitted frames (jams), their hanging hardware is removed, and they are taken to a single location for painting. The doors and the hardware hinges used to hang them may easily become mixed up with one another and replaced in different frames from whence they came. This is wasteful and inefficient since the doors and hardware must again be fitted and adjusted for the new frame.

Painting or treating doors or door jams in existing construction is cumbersome if the doors and hardware are removed since the few hardware hinges may become mixed up with each other and non-professionals may not re-hang the door properly. Alternatively, each of the hardware elements of the door or door jam may be covered with tape or other adhesive material allowing the door and door jam to be painted or treated in place.

As a result of these difficulties, certain paint masking devices for door hardware have been developed in the prior art. U.S. Pat. No. 4,195,590 to Herrington describes a set of reusable paint shields for door hinges, striker plates and door casings. One of the set of Herrington devices is designed to snugly and frictionally clip onto a door hinge butt plate after a door is removed. However, such devices are often difficult to remove after the paint is dry, or they tend to break or wear out quite quickly because of the how wide the clip is opened and closed over the door hinge. Thus, although the Herrington device is designed to be reusable, it is not.

The U.S. Pat. No. 4,802,259 to Geslewitz describes a different paint spatter shield for door hardware which relies on a cumbersome radial tab attached to the cylindrical portion which touches the door and interferes with the painting process of that portion of the door itself. The Geslewitz device may also include an adhesive surface to stay in place.

SUMMARY OF THE INVENTION

The present invention overcomes the disadvantages and drawbacks of the prior art by providing an easily removable, disposable painting mask for door hinge and butt plate hardware which is designed to be slided onto such hardware instead of being frictionally clipped thereon. The present invention includes a flattened plate attached to a cylindrical body and is distinguished by a longitudinal crease defining a weakened line along the cylindrical body and a tab on said plate. After use, pressure applied to the tab (by way of a screwdriver or the like) causes the invention to break along the weakened line so that it falls harmlessly from the door hardware in two disposable pieces.

It is therefore a primary object of the present invention to provide an inexpensive disposable mask to be placed over door hinge and butt plate hardware for protection during painting or treating.

It is a further important object of the present invention to provide a disposable mask to cover door hinge and butt plate hardware that may be easily slided over said hardware instead of being frictionally clipped thereon.

It is a further object of the present invention to provide a mask to cover door hinge and butt plate hardware that is easily removable and disposable.

It is a further object of the present invention to provide a disposable mask for protecting door hinge and door jam hardware during painting that may be broken off into two pieces after use.

DETAILED DESCRIPTION OF THE DRAWINGS

No attempt is made to show structural details of the invention in more detail than is necessary for a fundamental understanding of the invention, the description taken with drawings making apparent to those skilled in the art how the several forms of the invention may be embodied in practice.

Figure 1:
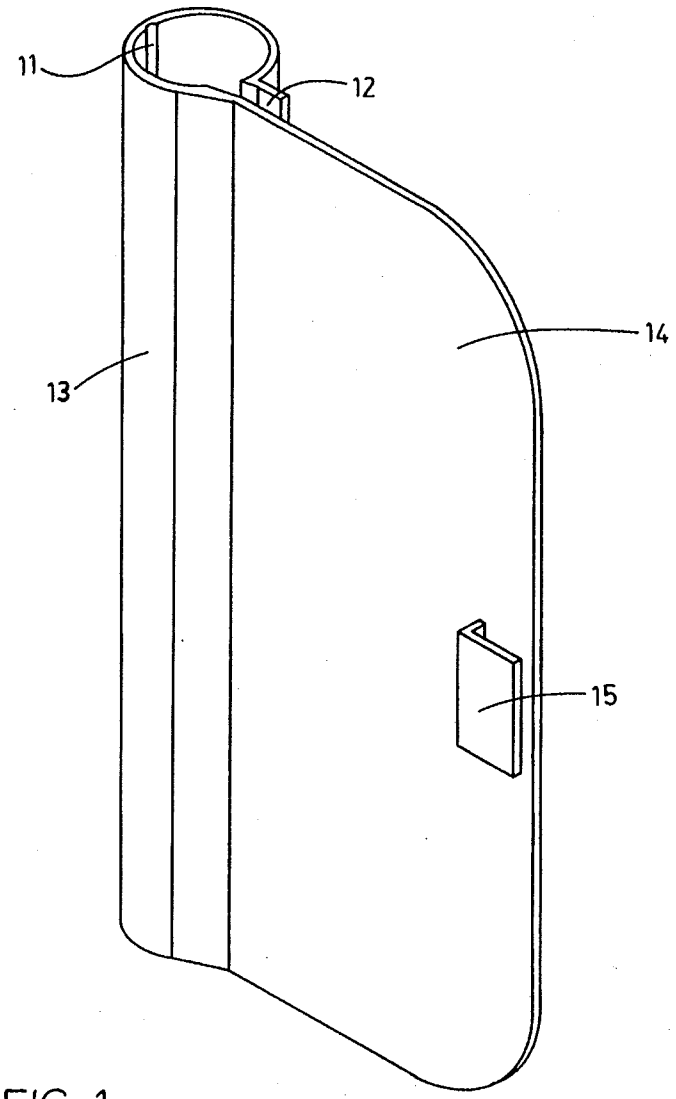
FIG. 1 is a perspective view of the invention.
Figure 3:
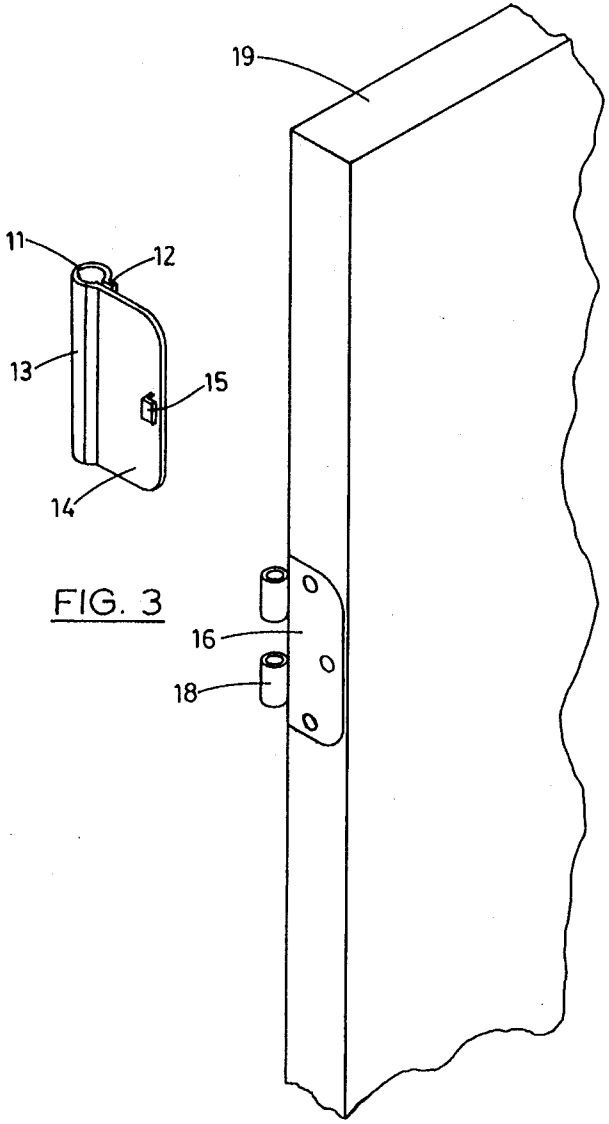
FIG. 3 is a perspective view of the invention showing how it may be placed over two-cylinder door hinge.
Figure 2:
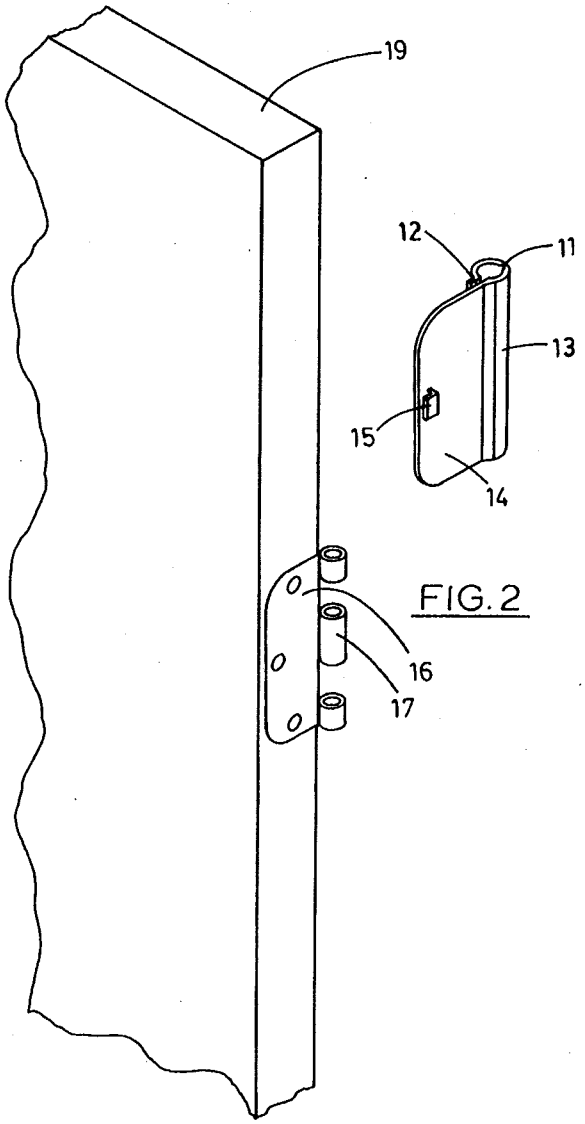
FIG. 2 is a perspective view of the invention showing how it may be placed over a three-cylinder door hinge.

Referring to the drawings wherein like reference characters designate like or corresponding parts throughout the several views, and referring particularly to FIG. 1, it is seen that the invention includes a flat flange or plate 14 attached to an open cylindrical tube 13 having a tab 12 at its opposite end. Tab 12 and plate 14 are parallel to each other. Tube 13 includes a longitudinal cut 11 on its inside surface opposite plate 14 along the entire length of the tube. Cut 11 weakens tube 13 along a line from top to bottom, allowing tube 13 to be easily broken in half long the cut 11. Plate 14 is provided with a tab 15 used in removing the invention from a door hinge.

Figure 4:
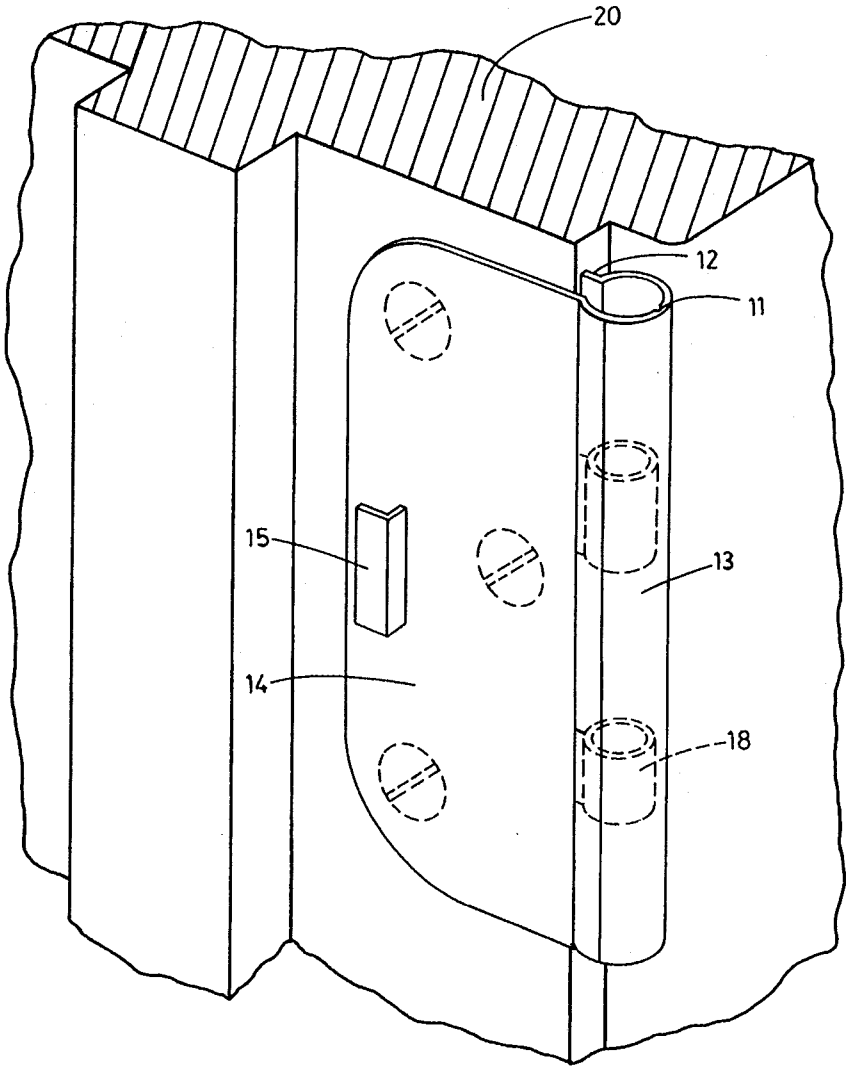
FIG. 4 is an environmental view of the invention showing it in place on a door hinge.

The invention is designed to be slided from top to bottom (or bottom to top) over a door hinge so that plate 14 covers the hinge butt plate 16. Tube 13 covers any number of cylindrical pins 17, 18 of the hinge as seen in FIG. 4. The door 19 or door jam 20 may then be painted, coated, or otherwise treated without affecting the hinge hardware.

In use, after a door is taken down, the invention may be slided over the door hinge while the hinge is still in place on the door or door jam/frame. The invention covers the hinge and butt plate and allows the door (or jam/frame) to be painted or treated without affecting the hinge or butt plate. After the paint is dry, a screwdriver or other tool may be used to apply pressure to the tab on the plate portion of the invention. This pressure is transferred to the weakened line along the cut (11) of the cylinder. When enough pressure is applied, the invention will break into two pieces along the cut so that the two pieces fall harmlessly off for disposal.

Figure 6:
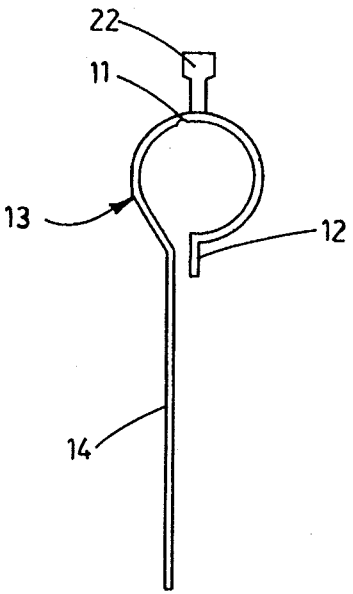
FIG. 6 is a top view of the embodiment of the invention shown in FIG. 5.
Figure 5:
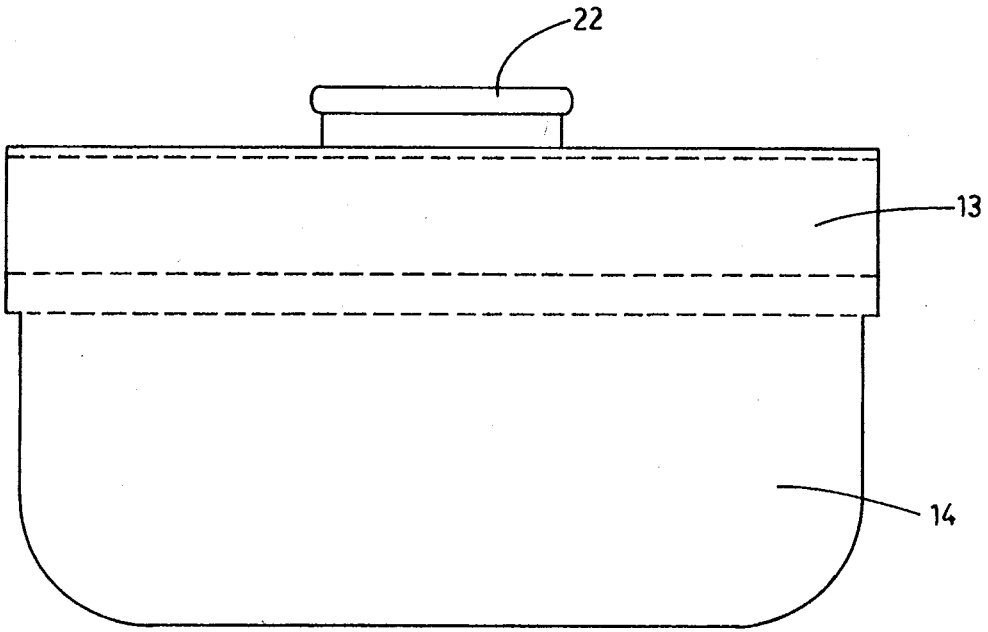
FIG. 5 is a front view of an alternative embodiment of the invention showing a different placement for the removal tab.

In the alternative embodiment shown in FIGS. 5 and 6, tab 15 is omitted, and a different tab 22 is provided on tube 13 opposite tab 12. After use, applying pressure to tab 22 causes the invention to break into two pieces along cut 11 for removal.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A masking device for a door hinge comprising:

a. a flat rectangular plate formed in the shape of a door hinge butt plate;

b. an open ended cylinder attached longitudinally along one of the longer sides of said plate; and c. a longitudinal partial cut in said cylinder along its length opposite from where said cylinder is attached to said flat rectangular plate.

2. The masking device described in claim 1 wherein a first tab is provided on said plate for allowing easy placement and removal of the invention from a door hinge.

3. The masking device described in claim 2 wherein a second tab is provided on said cylinder along its terminating side, said second tab being parallel to said flat rectangular plate.

4. The masking device described in claim 1 wherein a first tab is provided on said cylinder radially opposite of said plate for allowing easy placement and removal of the invention from a door hinge.

5. The masking device described in claim 4 wherein a second tab is provided on said cylinder along its terminating side, said second tab being parallel to said plate.

6. In combination, a door hinge with butt plate and a mask for use in painting, said mask comprising an open-ended cylindrical tube having a longitudinal opening running the length of one side of the tube and a weakened area running along the length of the side of the tube radially opposite said opening, and a cover plate attached to said tube along said opening, whereby said tube may be slided over said door hinge.

7. The combination described in claim 6 above wherein a first tab is provided on said plate for allowing easy placement and removal of the invention from a door hinge.

8. The combination described in claim 7 wherein a second tab is provided on said tube along the opposite side of said opening, said second tab being parallel to said plate.

9. The combination described in claim 6 wherein a first tab is provided on said tube radially opposite of said plate for allowing easy placement and removal of the invention from a door hinge.

10. The combination described in claim 9 wherein a second tab is provided on said tube along its terminating side, said second tab being parallel to said plate.

11. A masking device for a door hinge comprising an open-ended cylindrical tube having a longitudinal opening running the length of one side of the tube, a weakened area running along the length of the side of said tube located approximately opposite from said opening, and a cover plate attached to said tube adjacent to said opening.

12. The masking device described in claim 11 wherein a first tab is provided on said plate for allowing easy placement and removal of the invention from a door hinge.

13. The masking device described in claim 12 wherein a second tab is provided on said tube along the opposite side of said opening, said second tab being parallel to said cover plate.

14. The masking device described in claim 11 wherein a first tab is provided on said tube radially opposite of said plate for allowing easy placement and removal of the invention from a door hinge.

15. The combination described in claim 14 wherein a second tab is provided on said plate.

* * * * *